US007178904B2

(12) United States Patent
Anderson et al.

(10) Patent No.: US 7,178,904 B2
(45) Date of Patent: Feb. 20, 2007

(54) ULTRA-LOW ENERGY MICRO-FLUID EJECTION DEVICE

(75) Inventors: Frank E. Anderson, Sadieville, KY (US); Robert W. Cornell, Lexington, KY (US); Daniel L. Huber, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 266 days.

(21) Appl. No.: 10/986,338

(22) Filed: Nov. 11, 2004

(65) Prior Publication Data

US 2006/0098048 A1 May 11, 2006

(51) Int. Cl.
*B41J 2/05* (2006.01)
*H05B 3/00* (2006.01)

(52) U.S. Cl. ..... 347/63; 347/64; 347/56; 29/611

(58) Field of Classification Search ..... 347/20, 347/44, 47, 56–59, 61–65, 67; 29/890.1, 29/611

See application file for complete search history.

(56) References Cited

U.S. PATENT DOCUMENTS

| | | | | |
|---|---|---|---|---|
| 4,567,493 | A * | 1/1986 | Ikeda et al. | 347/64 |
| 4,595,823 | A | 6/1986 | Sorimachi et al. | 347/203 |
| 4,719,478 | A | 1/1988 | Tachihara et al. | 347/62 |
| 4,936,952 | A | 6/1990 | Komuro | 347/63 |
| 4,968,992 | A | 11/1990 | Komuro | 347/64 |
| 5,387,460 | A | 2/1995 | Hirakata et al. | 428/32.63 |
| 5,580,468 | A | 12/1996 | Fujikawa et al. | 216/27 |
| 5,682,185 | A | 10/1997 | Wade et al. | 347/57 |
| 5,697,144 | A | 12/1997 | Mitani et al. | 347/65 |
| 5,726,690 | A | 3/1998 | Bohorquez et al. | 347/15 |
| 5,742,307 | A | 4/1998 | Watrobski et al. | 347/62 |
| 5,831,648 | A | 11/1998 | Mitani et al. | 347/62 |
| 5,980,025 | A | 11/1999 | Burke et al. | 347/62 |
| 6,042,221 | A | 3/2000 | Komuro | 347/62 |
| 6,132,030 | A | 10/2000 | Cornell | 347/67 |
| 6,139,131 | A | 10/2000 | Prasad et al. | 347/63 |

(Continued)

FOREIGN PATENT DOCUMENTS

| | | |
|---|---|---|
| EP | 490668 | 6/1992 |

(Continued)

OTHER PUBLICATIONS

"Nucleation Quality and Bubble Momentum and Their Effect on Droplet Velocity and Stability," Robert Cornell, IS&Ts NIP 14, 1998 International Conference on Digital Printing Technologies, 1998, pp. 9-14.

*Primary Examiner*—Juanita D. Stephens
(74) *Attorney, Agent, or Firm*—Luedeka, Neely & Graham

(57) ABSTRACT

A micro-fluid ejection device for ultra-small droplet ejection and method of making a micro-fluid ejection device. The micro-fluid ejection device includes a semiconductor substrate containing a plurality of thermal ejection actuators disposed thereon. Each of the thermal ejection actuators includes a resistive layer and a protective layer for protecting a surface of the resistive layer. The resistive layer and the protective layer together define an actuator stack thickness. The actuator stack thickness ranges from about 500 to about 2000 Angstroms and provides an ejection energy per unit volume of from about 10 to about 20 gigajoules per cubic meter. A nozzle plate is attached to the semiconductor substrate to provide the micro-fluid ejection device.

20 Claims, 6 Drawing Sheets

U.S. PATENT DOCUMENTS

| | | | | |
|---|---|---|---|---|
| 6,227,640 | B1 | 5/2001 | Maze et al. | 347/64 |
| 6,244,682 | B1 | 6/2001 | Walker et al. | 347/19 |
| 6,315,853 | B1 | 11/2001 | Kubota et al. | 156/257 |
| 6,318,845 | B1 | 11/2001 | Mizutani | 347/57 |
| 6,331,049 | B1 | 12/2001 | Leban | 347/64 |
| 6,412,920 | B1 | 7/2002 | Matsumoto et al. | 347/58 |
| 6,467,864 | B1 | 10/2002 | Cornell | 347/62 |
| 6,478,410 | B1 | 11/2002 | Prasad et al. | 347/65 |
| 6,627,467 | B2 | 9/2003 | Haluzak et al. | 347/20 |
| 6,676,246 | B1 | 1/2004 | Anderson et al. | 347/62 |
| 6,698,868 | B2 * | 3/2004 | Trueba et al. | 347/63 |
| 2001/0008411 | A1 | 7/2001 | Maze et al. | 347/64 |
| 2002/0092519 | A1 | 7/2002 | Davis | |

FOREIGN PATENT DOCUMENTS

| | | |
|---|---|---|
| EP | 792745 | 9/1997 |
| EP | 1078757 | 2/2001 |
| JP | 06-320729 | 11/1994 |
| WO | WO 060676 | 7/2004 |

* cited by examiner

ULTRA-LOW ENERGY MICRO-FLUID EJECTION DEVICE

FIELD OF THE DISCLOSURE

The disclosure relates to micro-fluid ejection devices and in particular to ultra-low energy devices for ejecting ultra-small liquid droplets.

BACKGROUND AND SUMMARY

Since the inception of thermal fluid ejection devices, the size of droplets ejected by the devices has continually decreased. For the production of printed images by the ejection of inks, the droplet size need not be decreased below about 10 femtoliters (0.01 picoliters) as the spot size provided by such droplet is about 3 microns in diameters. Human vision measurements have shown that spot sizes of 42 microns are easily detectable, whereas spot sizes of less than 28 microns were substantially undetectable. Only about 0.07% of people can detect a spot size of about 20 microns, and less than 1 person per million can see a 3 micron spot. Nevertheless, fluid droplets of 10 femtoliters or less may be suitable for other non-printing applications including, but not limited to, pharmaceutical applications, electronics fabrication, and other applications where visual detection of spots of fluid on a media are not required.

One of the challenges for producing micro-fluid ejection devices for ultra-small droplets is the ability to provide high frequency droplet ejection without a substantial increase in wasted heat energy. For example, an ejection head containing 9000 nozzles operating at a frequency of 200 KHz and requiring 0.08 microjoules of energy per activation may require 144 watts of precisely regulated power resulting in about 0.125 picloliters per microjoule of energy. Such a power requirement results in a significant amount of wasted heat energy.

In order to reduce the amount of wasted heat energy for micro-fluid ejection devices for ultra-small fluid ejection, unique ejection devices and manufacturing techniques are needed.

With regard to the above, embodiments of the disclosure provides a micro-fluid ejection device for ultra-small droplet ejection and method of making a micro-fluid ejection device. The micro-fluid ejection device includes a semiconductor substrate containing a plurality of thermal ejection actuators disposed thereon. Each of the thermal ejection actuators includes a resistive layer and a protective layer for protecting a surface of the resistive layer. The resistive layer and the protective layer together define an actuator stack thickness. The actuator stack thickness ranges from about 500 to about 2000 Angstroms and provides an ejection energy per unit volume of from about 10 to about 20 gigajoules per cubic meter. A nozzle plate is attached to the semiconductor substrate to provide the micro-fluid ejection device.

In another embodiment there is provided a method of ejecting ultra-small fluid droplets on demand. The method includes providing a micro-fluid ejection device containing a resistive layer and a protective layer on the resistive layer. In combination, the resistive layer and protective layer define a thermal actuator stack. The thermal actuator stack has a thickness ranging from about 1000 to about 2500 Angstroms and a thermal actuator stack volume ranging from about 1 cubic micron to about 5.4 cubic microns. An electrical energy is applied to the thermal actuator stack sufficient to eject less than about 10 femtoliters of fluid from the micro-fluid ejection device with a pumping effectiveness of greater than about 125 femtoliters per microjoule to provide a fluid spot size ranging from about 1 up to about 3 microns on a substantially non-porous surface.

An advantage of embodiments of the disclosure is that apparatus for delivery of ultra-small volumes of liquids may be provided for use in electrical fabrication, pharmaceutical delivery, biotechnology research applications, and the like. Another advantage of the embodiments is that the methods may provide ultra-small volume delivery devices that may be fabricated in existing micro-fluid ejection device fabrication facilities.

BRIEF DESCRIPTION OF THE DRAWINGS

Further advantages of the embodiments will become apparent by reference to the detailed description of preferred embodiments when considered in conjunction with the drawings, wherein like reference characters designate like or similar elements throughout the several drawings as follows.

DETAILED DESCRIPTION OF PREFERRED EMBODIMENTS

In accordance with embodiments described herein, micro-fluid ejection actuators for micro-fluid ejection devices having improved operating characteristics for ultra-small drop volumes will now be described.

For the purposes of this disclosure, the term "ultra-small" is intended to include fluid droplets of less than about 10 femtoliters. The terms "heater stack", "ejector stack", and "actuator stack" are intended to refer to an ejection actuator having a combined layer thickness of a resistive material layer and passivation or protection material layer. The passivation or protection material layer is applied to a surface of the resistive material layer to protect the actuator from chemical or mechanical corrosion or erosion effects of fluids ejected by the micro-fluid ejection device.

Figure 1:
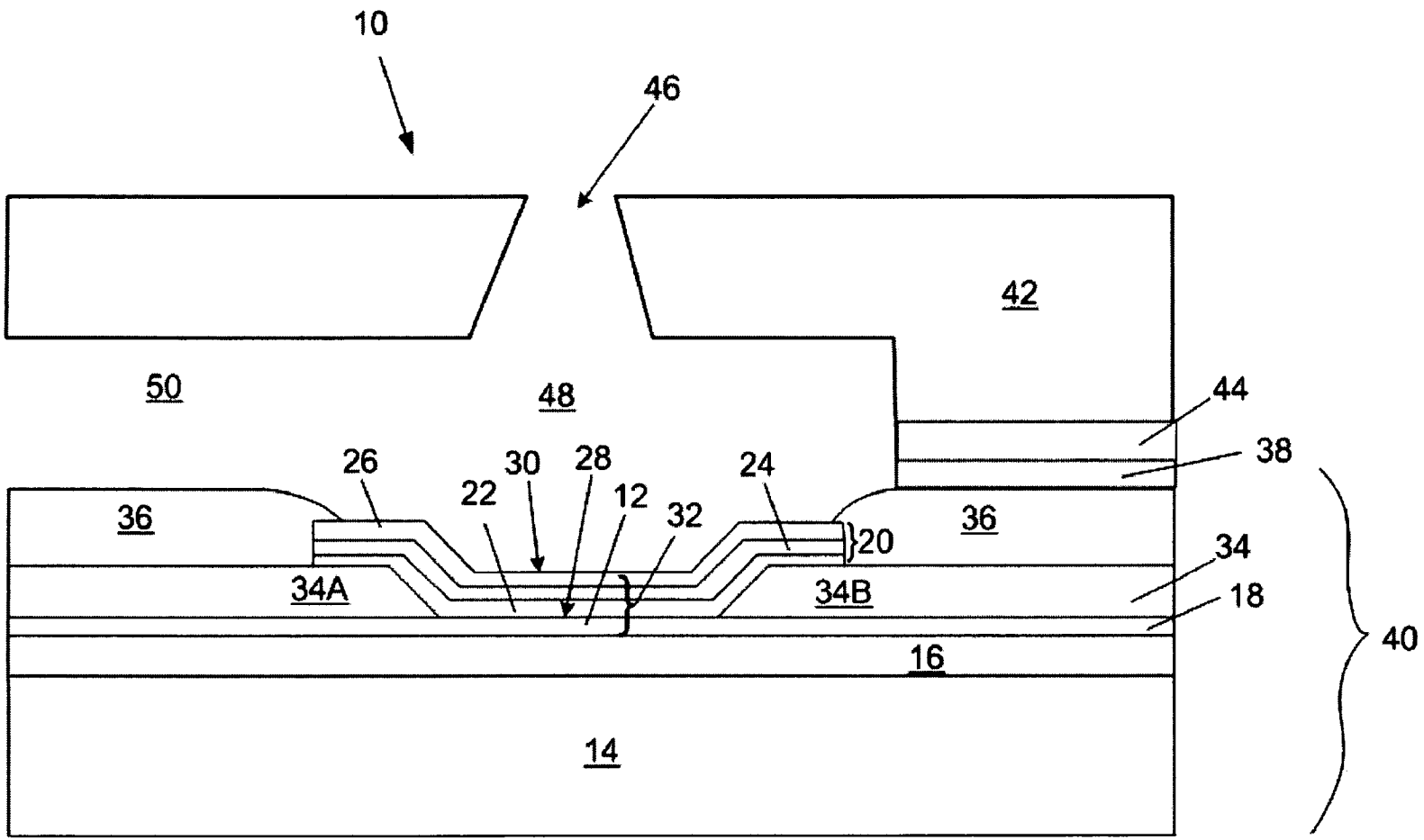
FIG. 1 Prior Art
FIG. 1 is a cross-sectional view, not to scale, of a portion of a prior art micro-fluid ejection head.

With reference to FIG. 1, a cross-sectional view, not to scale, of a portion of a prior art micro-fluid ejection head 10 is illustrated. The view of FIG. 1 shows one of many fluid ejection actuators 12. The fluid ejection actuators 12 are formed on a semiconductor silicon substrate 14 containing a thermal insulating layer 16 between the silicon substrate 14 and the ejection actuators 12. The fluid ejection actuators 12 may be formed from an electrically resistive material layer 18, such as TaAl, $Ta_2N$, TaAl(O,N), TaAlSi, TaSiC, Ti(N,O), Wsi(O,N), TaAlN, and TaAl/Ta. The thickness of the resistive material layer 18 may range from about 500 to about 1000 Angstroms.

The thermal insulation layer 16 may be formed from a thin layer of silicon dioxide and/or doped silicon glass overlying the relatively thick silicon substrate 14. The total thickness of the thermal insulation layer 16 is preferably from about 1 to about 3 microns thick. The underlying silicon substrate 14 may have a thickness ranging from about 0.5 to about 0.8 millimeters thick.

A protective layer 20 overlies the fluid ejection actuators 12. The protective layer 20 may be a single material layer or a combination of several material layers. In the illustration in FIG. 1, the protective layer 20 includes a first passivation layer 22, a second passivation layer 24, and a cavitation layer 26. The protective layer 20 is effective to prevent the fluid or other contaminants from adversely affecting the operation and electrical properties of the fluid ejection actuators 12 and provides protection from mechanical abrasion or shock from fluid bubble collapse.

The first passivation layer 22 may be formed from a dielectric material, such as silicon nitride, or silicon doped diamond-like carbon (Si-DLC) having a thickness of from about 1000 to about 3200 Angstroms thick. The second passivation layer 24 may also be formed from a dielectric material, such as silicon carbide, silicon nitride, or silicon-doped diamond-like carbon (Si-DLC) having a thickness preferably from about 500 to about 1500 Angstroms thick. The combined thickness of the first and second passivation layers 22 and 24 typically ranges from about 1500 to about 5000 Angstroms.

The cavitation layer 26 is typically formed from tantalum having a thickness greater than about 500 Angstroms thick. The cavitation layer 26 may also be made of TaB, Ti, TiW, TiN, WSi, or any other material with a similar thermal capacitance and relatively high hardness. The maximum thickness of the cavitation layer 26 is such that the total thickness of protective layer 20 is less than about 7200 Angstroms thick. The total thickness of the protective layer 20 is defined as a distance from a top surface 28 of the resistive material layer 18 to an outermost surface 30 of the protective layer 20. An ejector stack thickness 32 is defined as the combined thickness of layers 18 and 20.

The fluid ejection actuator 12 is defined by depositing and etching a metal conductive layer 34 on the resistive layer 18 to provide power and ground conductors 34A and 34B as illustrated in FIG. 1. The conductive layer 34 is typically selected from conductive metals, including but not limited to, gold, aluminum, silver, copper, and the like and has a thickness ranging from about 4,000 to about 15,000 Angstroms.

Overlying the power and ground conductors 34A and 34B is another insulating layer or dielectric layer 36 typically composed of epoxy photoresist materials, polyimide materials, silicon nitride, silicon carbide, silicon dioxide, spun-on-glass (SOG), laminated polymer and the like. The insulating layer 36 and has a thickness ranging from about 5,000 to about 20,000 Angstroms and provides insulation between a second metal layer 38 and conductive layer 34.

Layers 14, 16, 18, 20, 34, 36, and 38 provide a semiconductor substrate 40 for use in the micro-fluid ejection head 10. In order to complete the ejection head 10, a nozzle plate 42 is attached, as by an adhesive 44, to the semiconductor substrate 40. The nozzle plate 42 contains nozzle holes 46 corresponding the plurality of fluid ejection actuators 12. A fluid in fluid chamber 48 is heated by the fluid ejection actuators 12 to form a fluid bubble which expels fluid from the fluid chamber 48 through the nozzle holes 46. A fluid supply channel 50 provides fluid to the fluid chamber 48.

One disadvantage of the micro-fluid ejection head 10 described above is that the multiplicity of protective layers 20 within the micro-fluid ejection head 10 increases the ejection stack thickness 32, thereby increasing an overall jetting energy required to eject a drop of fluid through the nozzle holes 46.

Upon activation of the fluid ejection actuator 12, some of the energy ends up as waste heat energy used to heat the protective layer 20 via conduction, while the remainder of the energy is used to heat the fluid adjacent the surface 30 of the cavitation layer 26. When the surface 30 reaches a fluid superheat limit, a vapor bubble is formed. Once the vapor bubble is formed, the fluid is thermally disconnected from the surface 30. Accordingly, the vapor bubble prevents further thermal energy transfer to the fluid.

Figure 2:
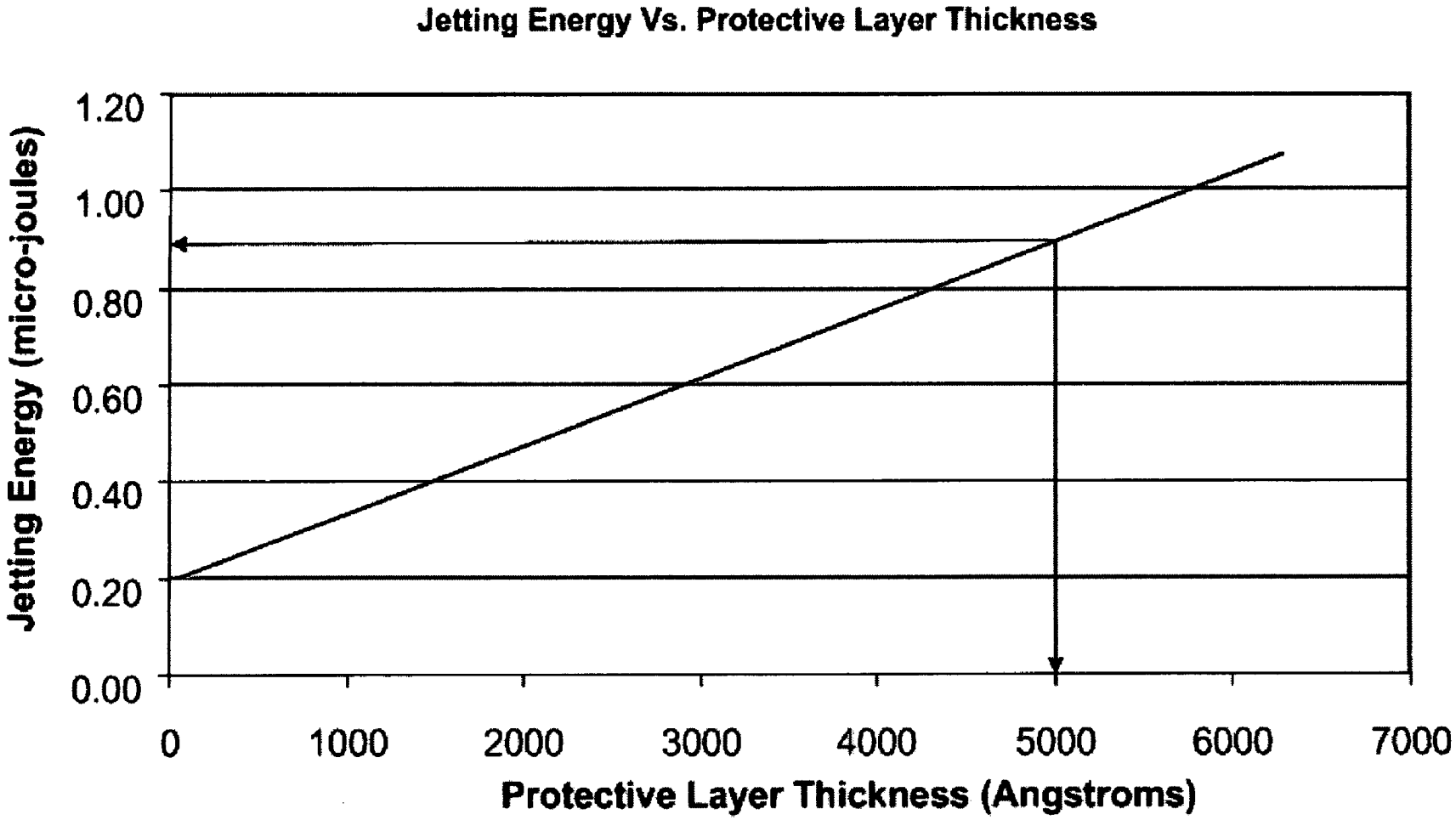
FIG. 2 is a graphical representation of jetting energy versus protective layer thickness for micro-fluid ejection heads.

It is the thermal energy transferred into the fluid, prior to bubble formation, that drives the liquid-vapor change of state of the fluid. Since thermal energy must pass through the protective layer 20 before heating the fluid, the protective layer 20 is also heated. It takes a finite amount of energy to heat the protective layer 20. The amount of energy required to heat the protective layer 20 is directly proportional to the thickness of the protective layer 20 and the thickness of the resistive layer 18. An illustrative example of the relationship between the protective layer 20 thickness and jetting energy requirement for a specific fluid ejection actuator 12 size is shown in FIG. 2.

Jetting energy is important because it is related to power (power being the product of energy and firing frequency of the fluid ejection actuators 12). The temperature rise experienced by the substrate 40 is also related to power. Adequate jetting performance and fluid characteristics, such as print quality in the case of an ink ejection device, are related to the temperature rise of the substrate 40.

Figure 3:
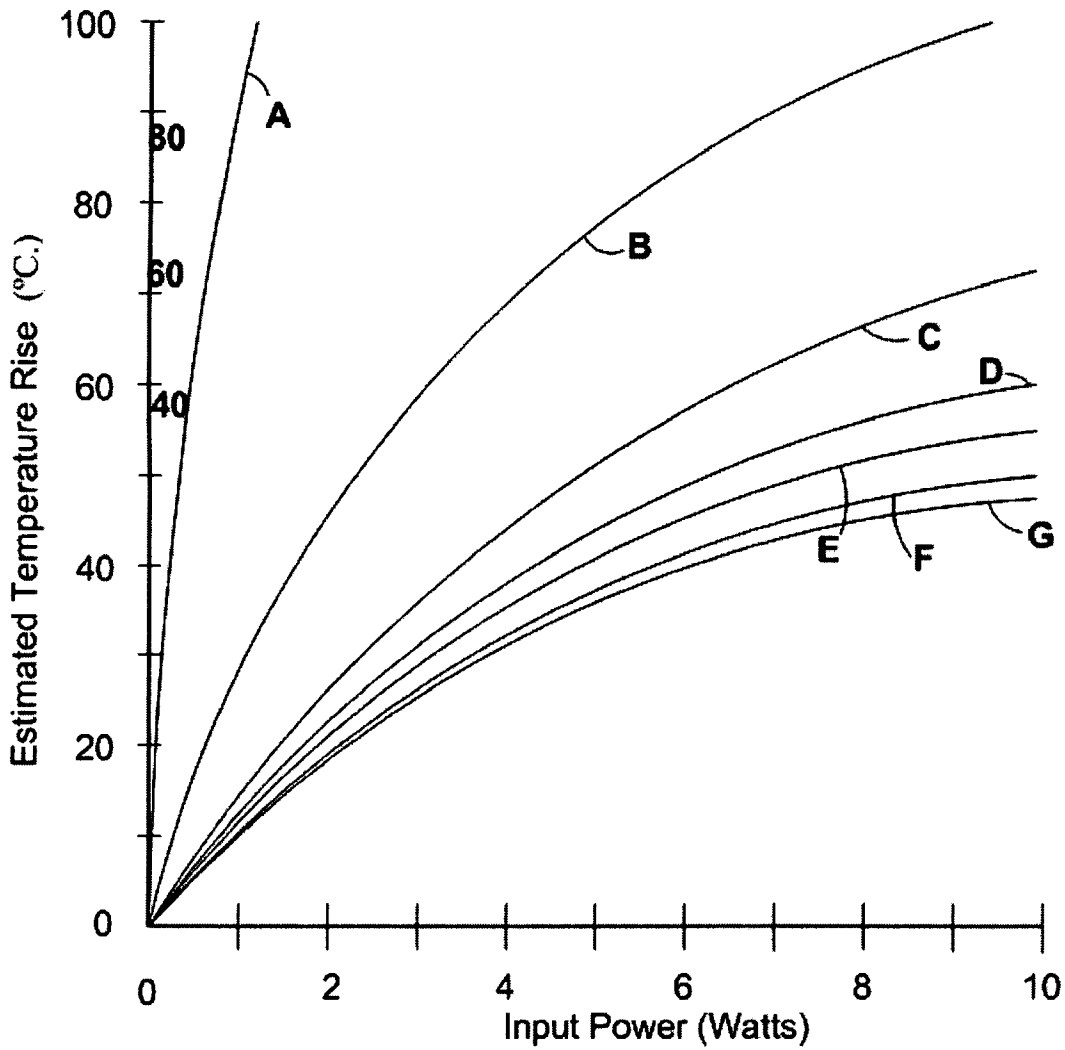
FIG. 3 is a graphical representation of estimated substrate temperature rise versus input power for ejection head pumping effectiveness.

FIG. 3 illustrates a relationship among the temperature rise of the substrate 40, input power to the fluid ejection actuator 12, and droplet size. The independent axis of FIG. 3 has units of power (or energy multiplied by frequency). In FIG. 3 the dependent axis denotes the temperature rise of the substrate 40. The series of curves (A–G) represent varying levels of pumping effectiveness for fluid droplet sizes (in this example, ink droplet sizes) of 1, 2, 3, 4, 5, 6, and 7 picoliters respectively. Pumping effectiveness is defined in units of picoliters per microjoule. As can be seen from FIG. 3, it is desirable to maximize pumping effectiveness. For the smaller droplet sizes (curves A and B), very little power input results in a rapid rise in the substrate 40 temperature. As the droplet size increases (curves C–G), the temperature rise of the substrate 40 is less dramatic. When a certain substrate temperature rise is reached, no additional energy (or power) can be sent to the ejection head 10 without negatively impacting ejection actuator 12 performance. If the maximum of allowable temperature rise of the substrate 40 is surpassed, performance and print quality, in the case of an ink ejection head, will be degraded.

Because power equals the product of energy and frequency, and the substrate 40 temperature is a function of input power, there is thus a maximum jetting frequency for operation of such micro-fluid ejection actuators 12. Accordingly, a primary goal of modern micro-fluid ejection head technology using the micro-fluid ejection actuators described herein is to maximize the level of jetting frequency while still maintaining the substrate 40 at an optimum temperature. While the optimum temperature of the substrate 40 varies due to other design factors, it is generally desirable to limit the substrate 40 temperature to about 75°

C. to prevent excessive flooding of the nozzle plate 42, air devolution, droplet volume variation, premature nucleation, and other detrimental effects.

With regard to the foregoing, providing the ejection head 10 with 9000 of the fluid ejection actuators 12 operating at a firing frequency of 200 KHz and requiring an energy of 0.08 microjoules per fire would require 144 watts of precisely regulated power. Such an ejection head 10 ejecting 10 femtoliters per fire would have a pumping effectiveness of 0.125 picoliters per microjoule. It will be appreciated from FIG. 3, that a pumping effectiveness of 0.125 picoliters per microjoule would result in an undesirable substrate temperature rise as the resulting curve would be to the left of curve A. Thus, there is a need for reducing the energy per fire in order to reduce power costs and improve the thermal performance of the ejection head.

The disclosed embodiments improve upon the prior art micro-fluid ejection head structures 10 by reducing the number layer and thickness of the protective layer 20 in the micro-fluid ejection head structure, thereby reducing a total ejection actuator stack thickness for a micro-fluid ejection head. A reduction in protective layer thickness translates into less waste energy and improved ejection head performance. Since there is less waste energy, jetting energy that was used to penetrate a thicker protective layer may now be allocated to higher jetting frequency while maintaining the same energy conduction as before to an exposed surface of the protective layer.

Figure 4:
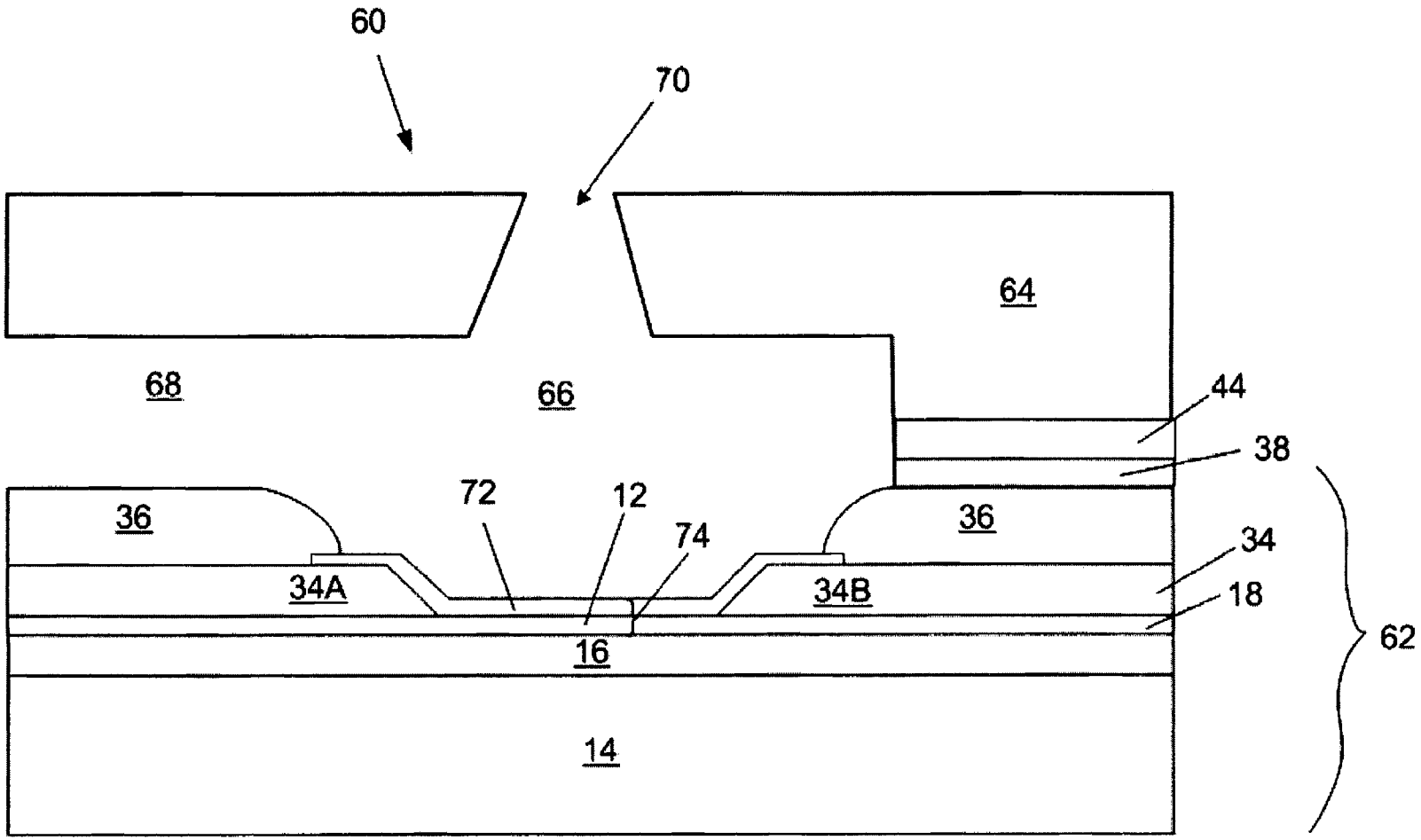
FIG. 4 is a cross-sectional view, not to scale, of a portion of a micro-fluid ejection head according to an embodiment of the disclosure.

With reference to FIG. 4, a cross sectional view, not to scale, of a portion of a micro-fluid ejection head 60 containing a semiconductor substrate 62 and nozzle plate 64 according to the disclosure is provided. In the embodiment shown in FIG. 4, the nozzle plate 64 has a thickness ranging from about 5 to 65 microns and is preferably made from an fluid resistant polymer such as polyimide. Flow features such as fluid chambers 66, fluid supply channels 68 and nozzle holes 70 are formed in the nozzle plate 64 by conventional techniques such as laser ablation. However, the embodiments are not limited by the foregoing nozzle plate 64. In an alternative, the fluid chambers 66 and the fluid supply channels 68 may be provided in a thick film layer to which a nozzle plate is attached or the flow features may be formed in both a thick film layer and a nozzle plate.

Unlike the ejection head 10 illustrated in FIG. 1, the ejection head 60 according to the disclosure contains a single protective layer 72. The protective layer 72 may be provided by a material selected from the group consisting of diamond-like carbon (DLC), titanium, tantalum, and an oxidized metal. For the purposes of ejecting fluid in the less than 10 femtoliter range, it is desirable for the protective layer to have a thickness ranging from about 100 to about 700 Angstroms. Such a protective layer 72 thickness provides an ejection actuator stack 74 having a thickness ranging from about 600 to about 1700 Angstroms.

In the case of a Ta—Al resistive layer 18, the protective layer 72 may be provided by an oxidized an upper about 100 to about 300 Angstrom portion of the Ta—Al resistive layer 18. Hence, the protective layer 72 may be provided by oxidizing the Ta—Al resistive layer 18 either by post deposition plasma, or in-situ by adding oxygen during the final moments of a sputtering deposition process for the resistive layer 18. A thin oxide protective layer 72 may provide all of the cavitation protection needed for the ejection of ultra-small fluid droplets through nozzle holes 70.

For example, an 800 Angstrom Ta—Al resistive layer 18 having a sheet resistance of about 28 ohms per square providing a ejection actuator 12 of about 1 square is provided. The ejection actuator 12 contains a 200 Angstrom oxidized protective layer 72 which may be effective to lower the applied current for the fluid ejection actuator 12 from about 45 milliamps to about 18 milliamps with a nucleation response similar to the nucleation response of the ejection head 10 illustrated in FIG. 1. In this example, the energy of the ejection actuator 12 is reduced from about 0.06 microjoules to about 0.01 microjoules, a six-fold improvement in ejection energy per fluid droplet. For an ejection actuator stack 74 having a volume ranging from about 1 cubic micron to about 6 cubic microns, the ejection energy per unit volume of the actuator stack 74 may range from about 10 to about 20 gigajoules per cubic meter. The pumping effectiveness for less than 10 femtoliter droplets may range from greater than about 125 femtoliters per microjoule to about 900 femtoliters per microjoule or more.

Figure 5:
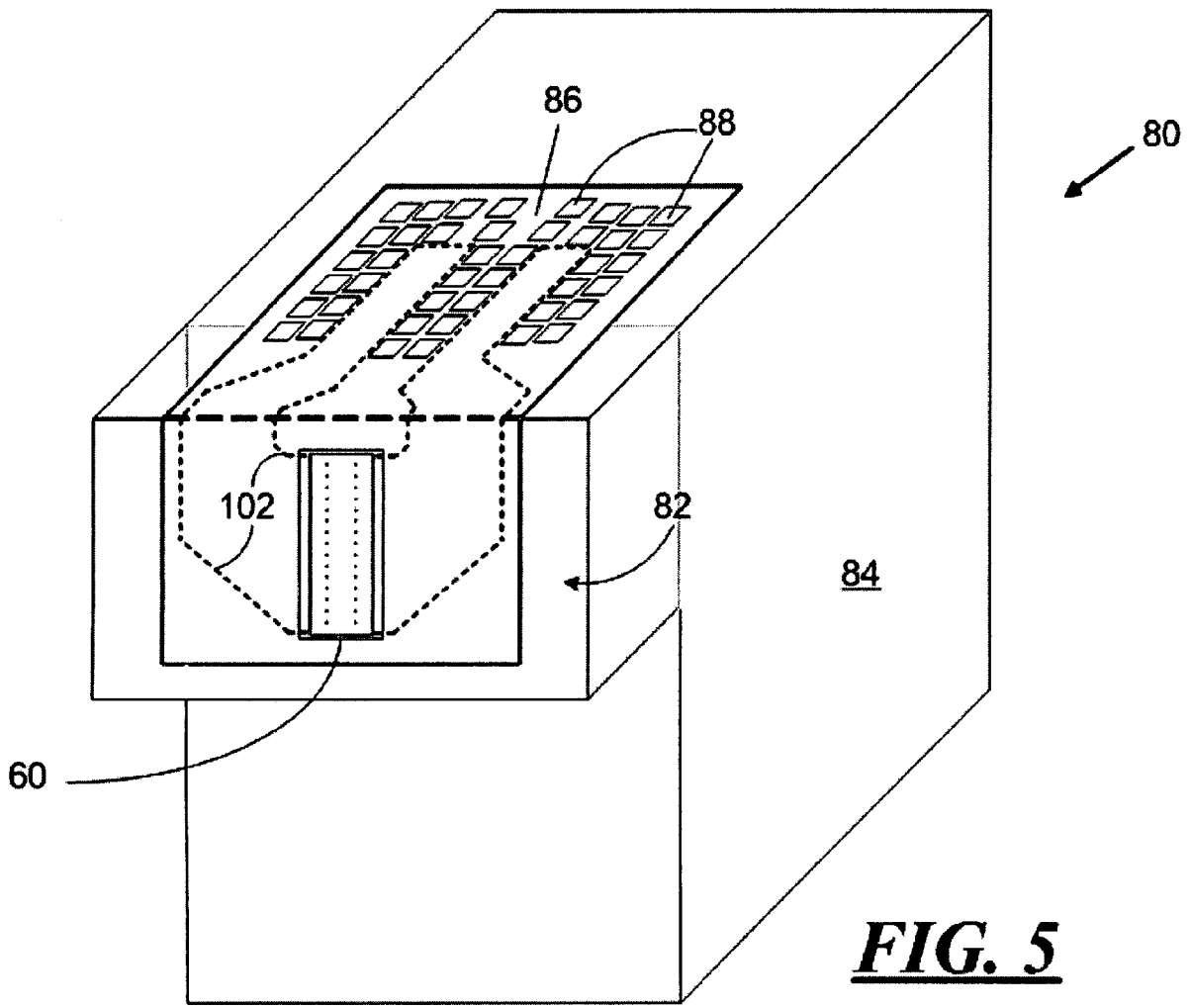
FIG. 5 is a perspective view of a fluid cartridge containing a micro-fluid ejection head according to the disclosure.

The micro-fluid ejection head 60 for ultra-small fluid droplets may be attached to a fluid supply cartridge 80 as shown in FIG. 5. As shown in FIG. 5, the ejection head 60 is attached to an ejection head portion 82 of the fluid cartridge 80. A main body 84 of the cartridge 80 includes a fluid reservoir for supply of fluid to the micro-fluid ejection head 60. A flexible circuit or tape automated bonding (TAB) circuit 86 containing electrical contacts 88 for connection to an ejection head control device 100 (FIG. 6) is attached to the main body 84 of the cartridge 80. Electrical tracing 102 from the electrical contacts 88 are attached to the semiconductor substrate 62 (FIG. 4) to provide activation of ejection actuators 12 on the substrate 62 on demand from the control device 100 to which the fluid cartridge 80 is attached. The disclosure, however, is not limited to the fluid cartridges 80 as described above as the micro-fluid ejection head 60 according to the disclosure may be used for a wide variety of fluid cartridges, wherein the ejection head 60 may be remote from the fluid reservoir of main body 84.

Figure 6:
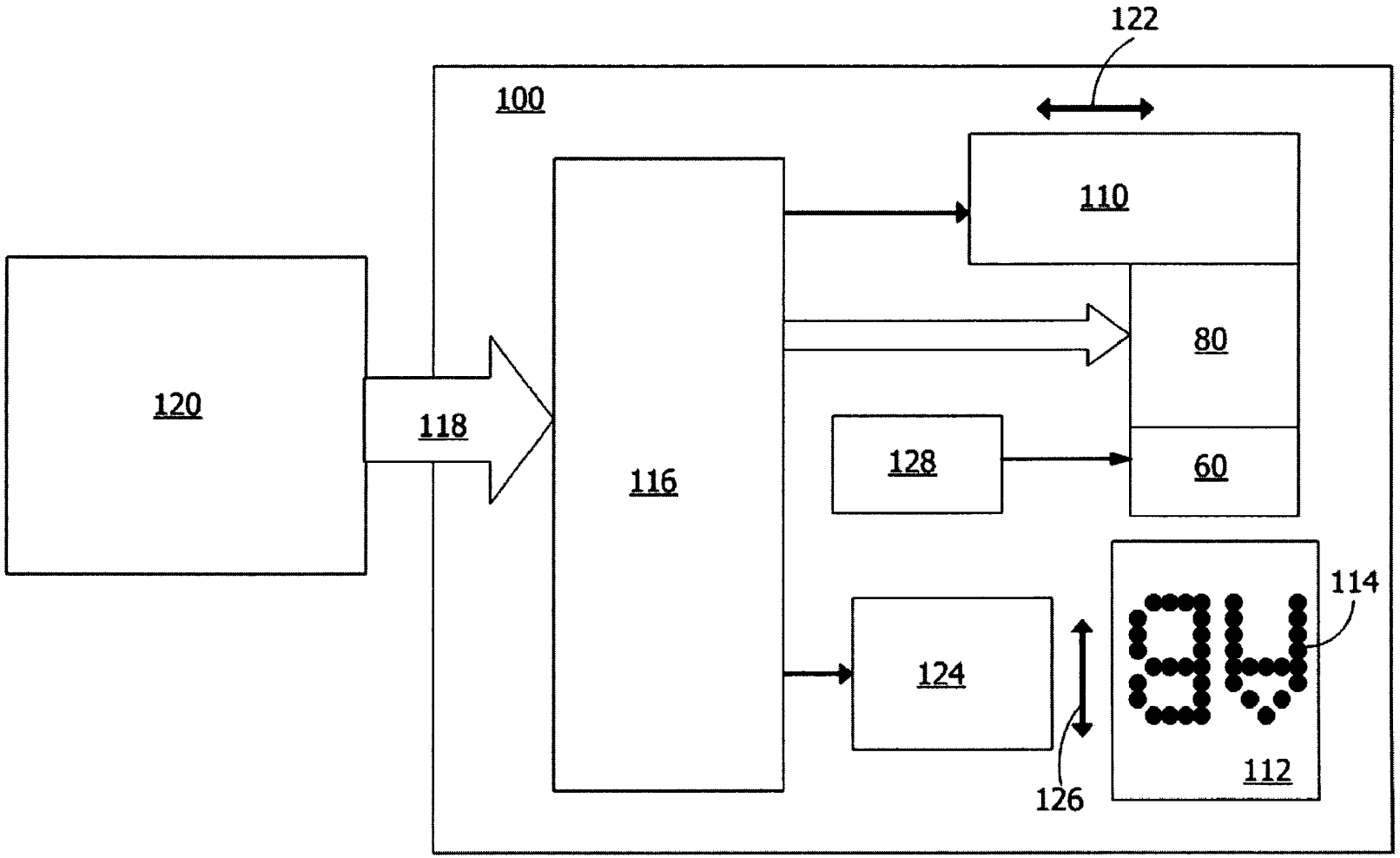
FIG. 6 is a schematic drawing of a control device for controlling a micro-fluid ejection head according to the disclosure.

An illustrative control device 100 for activation of the ejection head 60 is illustrated in FIG. 6. For the purpose of illustration only, the control device 100 is described as an ink jet printer. However, the control device 100 may be provided by any devices or combination of devices suitable for activating the ejection head 60 on demand.

In FIG. 6, the cartridge 80 containing ejection head 60 is attached to a scanning mechanism 110 that moves the cartridge 80 and ejection head 60 across a fluid delivery media 112. In the case of the control device 100 being an ink jet printer, indicia 114 is printed on the media 112.

The control device 100 includes a digital microprocessor 116 that receive input data 118 a host computer 120. In the case of an ink jet printer, the input data 118 is image data generated by a host computer 120 that describes the indicia 114 to be printed in a bit-map format.

During operation of the control device 100, the scanning mechanism 110 moves the cartridge 80 across the media 112 in a scanning direction as indicated by arrow 122. The scanning mechanism 110 may include a carriage that slides horizontally on one or more rails, a belt attached to the carriage, and a motor that engages the belt to cause the carriage to move along the rails. The motor is driven in response to the commands generated by the digital microprocessor 116.

The control device 100 may also include a media advance mechanism 124 that moves the media 112 in the direction of arrow 126 based on input commands from the digital microprocessor 116. Typically, the advance mechanism 124 advances the media 112 between consecutive scans of the cartridge 80 and ejection head 60. In one embodiment, the media advance mechanism 124 is a stepper motor rotating a platen which is in contact with the media 112. The control device 100 also includes a power supply 128 for providing a supply voltage to the ejection head 60, scanning mechanism 110 and media advance mechanism 124.

It is contemplated, and will be apparent to those skilled in the art from the preceding description and the accompanying drawings, that modifications and changes may be made in the embodiments of the disclosure. Accordingly, it is expressly intended that the foregoing description and the accompanying drawings are illustrative of preferred embodiments only, not limiting thereto, and that the true spirit and scope of the present disclosure be determined by reference to the appended claims.

What is claimed is:

1. A micro-fluid ejection device for ultra-small droplet ejection, comprising:

a semiconductor substrate containing a plurality of thermal ejection actuators disposed thereon, each of the thermal ejection actuators including a resistive layer and a protective layer for protecting a surface of the resistive layer, the resistive layer and the protective layer together defining an actuator stack thickness; and a nozzle plate attached to the semiconductor substrate, wherein the actuator stack thickness ranges from about 500 to about 2000 Angstroms and provides an ejection energy per unit volume of from about 10 to about 20 gigajoules per cubic meter.

2. The micro-fluid ejection device of claim 1, wherein the thermal ejection actuator has a thickness ranging from about 400 to about 1000 Angstroms.

3. The micro-fluid ejection device of claim 2, wherein the thermal ejection actuator has a fluid heating area ranging from about four square microns to about twelve square microns.

4. The micro-fluid ejection device of claim 1, wherein the thermal ejection actuator has a fluid heating area ranging from about four square microns to about twelve square microns.

5. The micro-fluid ejection device of claim 1, wherein the protective layer has a thickness ranging from about 100 to about 700 Angstroms.

6. The micro-fluid ejection device of claim 1, wherein the thermal fluid actuator comprises a tantalum-aluminum alloy and the protective layer comprises a material selected from the group consisting of diamond like carbon, titanium, tantalum, and an oxidized metal layer.

7. The micro-fluid ejection device of claim 6, wherein the thermal fluid actuator comprises a material selected from the group consisting of tantalum-aluminum (TaAl), tantalum-nitride (TaN), tantalum-aluminum-nitride (TaAl:N), and composite layers of tantalum and tantalum-aluminum (Ta+TaAl).

8. The micro-fluid ejection device of claim 7, wherein the protective layer comprises a tantalum oxide layer.

9. A method of making a micro-fluid ejection device for ejection of ultra-low volume fluid droplets, the method comprising the steps of:

providing a semiconductor substrate having a device surface thereof;

depositing a resistive layer on the device surface of the substrate, the resistive layer having a thickness ranging from about 400 to about 1000 Angstroms;

applying a protective layer to the resistive layer, the protective layer having a thickness ranging from about 100 to about 700 Angstroms, wherein a combined thickness of the resistive layer and the protective layer provides an ejection energy per unit volume of from about 10 to about 20 gigajoules per cubic meter; and attaching a nozzle plate to the device surface of the semiconductor substrate.

10. The method of claim 9, further comprising defining a thermal ejection actuator by depositing power and ground conductors on the resistive layer prior to applying the protective layer to the resistive layer.

11. The method of claim 10, wherein a plurality of thermal ejection actuators are defined on the device surface of the semiconductor substrate, each of the thermal ejection actuators having a surface area dimension ranging from about four square microns to about twelve square microns.

12. The method of claim 9, wherein a resistive layer selected from the group consisting of tantalum-aluminum (TaAl), tantalum-nitride (TaN), tantalum-aluminum-nitride (TaAl:N), and composite layers of tantalum and tantalum-aluminum (Ta+TaAl) is deposited on the device surface of the substrate.

13. The method of claim 9, wherein a protective layer selected from the group consisting of diamond like carbon, titanium, tantalum, and metal oxides is applied to the resistive layer.

14. The method of claim 9, wherein the step of applying a protective layer to the resistive layer comprises oxidizing a surface of the resistive layer to provide and oxidized metal protective layer.

15. The method of claim 14, wherein the oxidized metal protective layer comprises an oxide of tantalum.

16. A micro-fluid ejection device made by the method of claim 9.

17. A method of ejecting ultra-small fluid droplets on demand, comprising:

providing a micro-fluid ejection device containing a resistive layer and a protective layer on the resistive layer, the resistive layer and protective layer in combination defining a thermal actuator stack, wherein the thermal actuator stack has a thickness ranging from about 500 to about 2000 Angstroms and a thermal actuator stack volume ranging from about 1 cubic micron to about 5.4 cubic microns; and applying electrical energy to the thermal actuator stack sufficient to eject less than about 10 femtoliters of fluid from the micro-fluid ejection device with a pumping effectiveness of greater than about 125 femtoliters per microjoule, whereby a spot size ranging from about 1 up to about 3 microns is produced by each fluid droplet on a substantially non-porous surface.

18. The method of claim 17, wherein the pumping effectiveness ranges from about 500 to about 900 femtoliters per microjoule.

19. The method of claim 17, wherein the droplet volume ranges from about 5 up to less than about 10 femtoliters.

20. The method of claim 17, wherein the electrical energy applied to the thermal actuator stack ranges from about 10 to about 20 gigajoules per cubic meter.

* * * * *